US009692136B2

(12) United States Patent
Fasenfest

(10) Patent No.: US 9,692,136 B2
(45) Date of Patent: Jun. 27, 2017

(54) MONOCONE ANTENNA

(71) Applicant: Tyco Electronics Corporation, Berwyn, PA (US)

(72) Inventor: Kathleen Fasenfest, Union City, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 248 days.

(21) Appl. No.: 14/263,563

(22) Filed: Apr. 28, 2014

(65) Prior Publication Data

US 2015/0311593 A1 Oct. 29, 2015

(51) Int. Cl.

| | |
|---|---|
| ***H01Q 9/28*** | (2006.01) |
| ***H01Q 13/02*** | (2006.01) |
| ***H01Q 1/28*** | (2006.01) |
| ***H01Q 9/40*** | (2006.01) |
| *H01Q 13/04* | (2006.01) |

(52) U.S. Cl.

CPC ..... *H01Q 13/02* (2013.01); *H01Q 1/286* (2013.01); *H01Q 9/40* (2013.01)

(58) Field of Classification Search

CPC ..... H01Q 13/18; H01Q 1/286; H01Q 1/38; H01Q 1/36; H01Q 1/2241; H01Q 1/32; H01Q 1/3216; H01Q 1/325; H01Q 1/3258; H01Q 1/3266; H01Q 1/3275; H01Q 1/3291; H01Q 1/28; H01Q 1/285; H01Q 1/48; H01Q 1/085; H01Q 9/28; H01Q 9/40; H01Q 9/0407; H01Q 13/04; H01Q 11/06

USPC ..... 343/773, 774, 846, 848, 898, 899, 789, 343/705, 769, 792

See application file for complete search history.

(56) References Cited

U.S. PATENT DOCUMENTS

| | | | | |
|---|---|---|---|---|
| 3,680,130 A * | 7/1972 | Jones, Jr. | H01Q 1/281 | 343/708 |
| 3,680,131 A * | 7/1972 | Hall | H01Q 9/40 | 343/710 |
| 4,074,268 A * | 2/1978 | Olson | H01Q 3/28 | 342/399 |
| 4,115,783 A * | 9/1978 | Reggia | H01Q 1/08 | 343/792 |
| 4,949,094 A | 8/1990 | Yukl | | |

(Continued)

FOREIGN PATENT DOCUMENTS

| | | |
|---|---|---|
| JP | 2007-097115 A | 4/2007 |
| WO | WO-2009/110131 A1 | 9/2009 |

OTHER PUBLICATIONS

A wideband, Low profile, Shorted top Hat Monocone Antenna, Aten et al., Dated Oct. 10, 2012.*

(Continued)

*Primary Examiner* — Dameon E Levi
*Assistant Examiner* — Awat Salih

(57) ABSTRACT

A monocone antenna includes a conical radiation element having a feed point at a vertex of the conical radiation element being connected to a feed transmission line and a capacitive ring radially outside of the conical radiation element and in proximity to the conical radiation element. The capacitive ring is connected to a ground plane of the monocone antenna. Optionally, a capacitive gap may be defined between the conical radiation element and the capacitive ring that is substantially filled with dielectric material.

11 Claims, 3 Drawing Sheets

(56) References Cited

U.S. PATENT DOCUMENTS 6,693,600 B1 * 2/2004 Elliot ..... H01Q 1/27 343/715
6,919,846 B2 * 7/2005 Koch ..... H01Q 1/281 102/214
7,027,004 B2 * 4/2006 Haunberger ..... H01Q 9/40 343/790
7,289,079 B2 * 10/2007 Rupp ..... H01Q 1/42 343/772
7,626,558 B2 12/2009 Kuroda et al.
7,642,975 B2 * 1/2010 Brunks ..... B64D 45/02 343/705
7,973,731 B2 * 7/2011 Parsche ..... H01Q 9/28 343/772
7,999,757 B2 * 8/2011 Du ..... H01Q 1/007 343/772
8,228,257 B2 * 7/2012 Lalezari ..... H01Q 9/28 343/792
8,729,440 B2 * 5/2014 Parsche ..... H05B 6/72 166/177.1
2004/0183736 A1 * 9/2004 Sato ..... H01Q 1/243 343/725
2005/0122274 A1 * 6/2005 Marsan ..... H01Q 1/28 343/773
2005/0140557 A1 * 6/2005 Kuroda ..... H01Q 1/38 343/773
2005/0264462 A1 * 12/2005 Yanagi ..... H01Q 9/40 343/773
2006/0022885 A1 * 2/2006 Ida ..... H01Q 9/28 343/773
2006/0250315 A1 * 11/2006 Parsche ..... H01Q 9/28 343/773
2007/0013597 A1 * 1/2007 Sugawara ..... H01Q 9/28 343/773
2007/0126637 A1 * 6/2007 Habib ..... H01Q 1/36 343/700 MS
2007/0216595 A1 * 9/2007 Hashiyama ..... H01Q 19/09 343/848
2009/0237314 A1 * 9/2009 Lalezari ..... H01Q 21/10 343/721
2010/0085264 A1 * 4/2010 Du ..... H01Q 21/28 343/772
2011/0063182 A1 * 3/2011 Sanford ..... H01Q 9/0407 343/846
2011/0279342 A1 * 11/2011 Takahashi ..... H01Q 9/0407 343/845
2014/0002319 A1 * 1/2014 Lindenmeier ..... H01Q 1/3275 343/725
2014/0176386 A1 * 6/2014 Rentz ..... H01Q 1/50 343/836
2014/0184467 A1 * 7/2014 Yona ..... H01Q 5/328 343/860
2015/0015447 A1 * 1/2015 Yona ..... H01Q 1/48 343/786
2015/0042536 A1 * 2/2015 Emerick ..... H01Q 9/40 343/843
2015/0255874 A1 * 9/2015 Hung ..... H01Q 5/357 343/786

OTHER PUBLICATIONS

Daniel W. Aten et al., "A wideband, Low Profile, Shorted Top Hat Monocone Antenna", IEEE Transactions on Antennas and Propagation, vol. 60, No. 10, Jul. 5, 2012, pp. 4485-4491.
International Search Report for International Application No. PCT/US2015/026604, mailed Jun. 26, 2015.

* cited by examiner

MONOCONE ANTENNA

BACKGROUND OF THE INVENTION

The subject matter disclosed herein relates generally to communication antennas and identification antennas, such as for vehicular installations.

Antennas are used for transmitting and receiving electromagnetic radiation for communication applications, identifications applications, and the like. Some antennas use vertically polarized antennas to efficiently transmit and receive vertically polarized signals. For example, vertical polarization is commonly used for aircraft communications and identification applications. Monopole and monocone antennas are types of vertically polarized antennas. For a typical monopole or monocone installation, the antenna is one quarter wavelength in height above the mounting surface, such as above the aircraft surface. The antenna creates aerodynamic drag and the antennas can easily be damaged due to their protrusion above the surface. Merely shortening the antenna increases the inductance of the antenna, which detrimentally affects the performance of the antenna. A need remains for a conformal vertically-polarized antenna for particular applications, such as installation on airborne platforms including commercial, military and general aviation platforms.

BRIEF DESCRIPTION OF THE INVENTION

In one embodiment, a monocone antenna is provided including a conical radiation element having a feed point at a vertex of the conical radiation element being connected to a feed transmission line and a capacitive ring radially outside of the conical radiation element and in proximity to the conical radiation element. The capacitive ring is connected to a ground plane of the monocone antenna. Optionally, a capacitive gap may be defined between the conical radiation element and the capacitive ring that is substantially filled with dielectric material.

Optionally, the conical radiation element may extend vertically between an open top and a vertex at a bottom of the conical radiation element. The capacitive ring may extend vertically from a top to a bottom. The top of the capacitive ring may be generally coplanar with the top of the conical radiation element and the bottom of the capacitive ring may be generally coplanar with the bottom of the conical radiation element.

Optionally, the monocone antenna may include a substrate having a conical cavity open at a top of the substrate. The conical radiation element may be located in the conical cavity. The capacitive ring may be positioned on an exterior of the substrate. A width of the substrate between the conical radiation element and capacitive ring may be variable along a height of the substrate between the top and bottom of the substrate.

Optionally, the substrate may have a base, a top and a side wall between the base and the top. The capacitive ring may be positioned on the base, the top and the side wall. The conical radiation element may be deposited directly on an inner cavity wall of the substrate defining the conical cavity. The capacitive ring may be deposited directly on the base, the top and the side wall. The substrate may have an exposed surface at the top between the capacitive ring and the conical radiation element.

Optionally, the substrate may have a mounting flange at the top. The mounting flange may have an upper surface, a lower surface and a side surface between the upper surface and the lower surface. The capacitive ring may extend along the upper surface, the side surface and the lower surface. The base may extend below the mounting flange. The base may have a side surface and a lower surface defining a bottom of the substrate. The side surface may define at least a portion of the side wall. The capacitive ring may extend along the lower surface of the base and the side surface of the base to the lower surface of the mounting flange. The side surface of the base may extend vertically between the lower surface of the base and the mounting flange. The side surface of the base may be angled between the lower surface of the base and the mounting flange. The side surface of the base may extend generally parallel to an inner cavity wall defining the conical cavity.

In another embodiment, a monocone antenna is provided that includes a substrate having a base and a top with a side wall between the base and the top. The substrate has a conical cavity open at the top and tapering inward toward the base. The conical cavity is defined by an inner cavity wall. A conical radiation element is provided on the inner cavity wall. A capacitive ring is provided on the exterior side wall radially outside of the conical radiation element and in proximity to the conical radiation element.

DETAILED DESCRIPTION OF THE INVENTION

Figure 1:
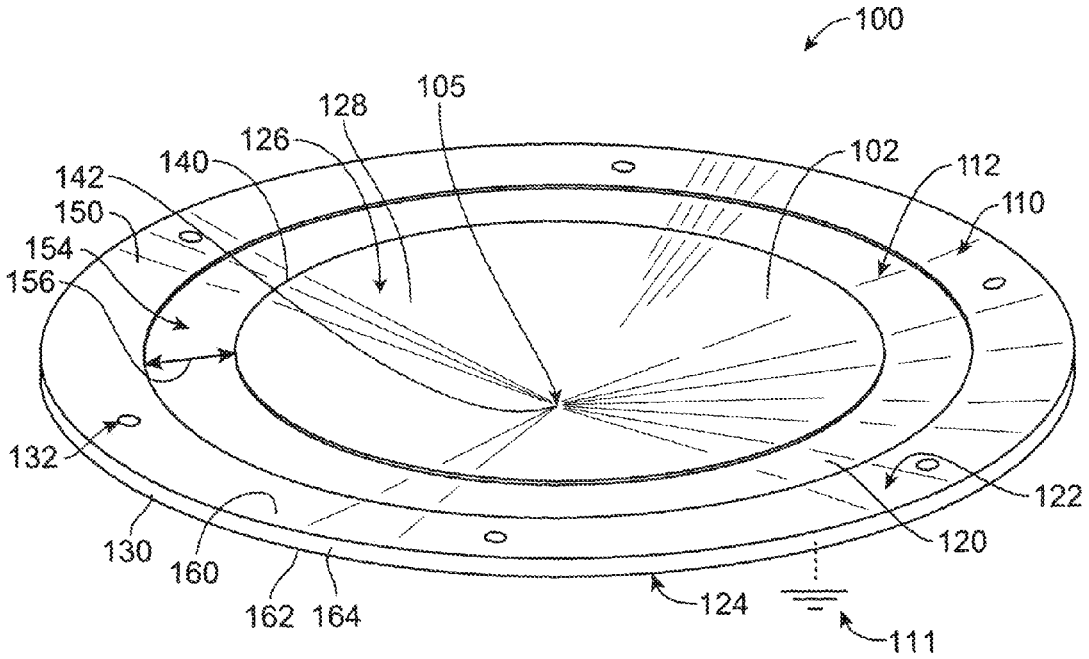
FIG. 1 is a top perspective view of a monocone antenna formed in accordance with an exemplary embodiment.
Figure 2:
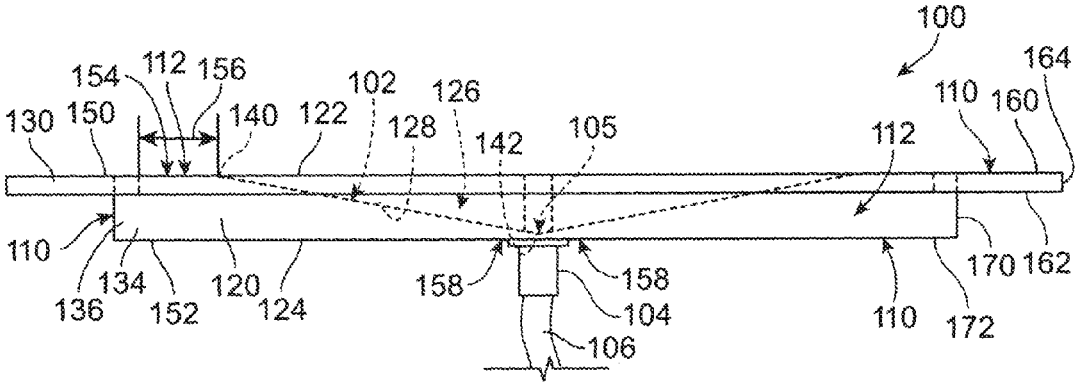
FIG. 2 is a side view of the monocone antenna.
Figure 3:
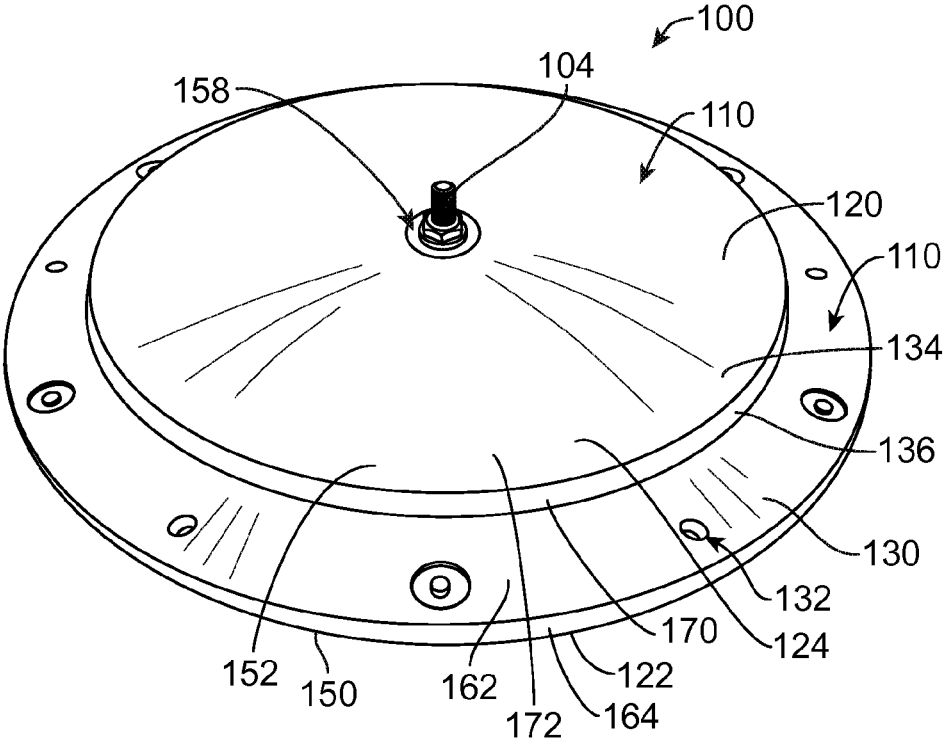
FIG. 3 is a bottom view of the monocone antenna.

FIG. 1 is a top perspective view of a monocone antenna 100 formed in accordance with an exemplary embodiment. FIG. 2 is a side view of the monocone antenna 100. FIG. 3 is a bottom view of the monocone antenna 100.

The monocone antenna 100 may be either a radiator or receiver of electromagnetic signals, such as radio frequency (RF) signals. In an exemplary embodiment, the monocone antenna 100 is a conformal antenna for installation on an airborne platform, such as a commercial, military, or general aviation platform. The conformal antenna 100 may be used as a communication antenna and/or an identification antenna for an airborne vehicle. The monocone antenna 100 has a very low profile to reduce or eliminate aerodynamic drag and potential for damage. Optionally, the monocone antenna 100 may be embedded in a surface of the aircraft such that the monocone antenna 100 has little or no protrusion above the airframe. The monocone antenna 100 is designed to be electrically short to increase its conformity. In an exemplary embodiment, the monocone antenna is less than one-tenth of a free space wavelength in height.

The monocone antenna 100 includes a conical radiation element 102 that defines a radiator of the monocone antenna 100. The conical radiation element 102 has a feed point 104 at a vertex 105 of the conical radiation element 102. The feed point 104 is configured to be connected to a feed transmission line 106 (shown in FIG. 2), which may be a cable or other type of feed transmission line. The feed point 104 may be an RF connector, such as a sub-miniature type A (SMA) connector.

The monocone antenna 100 includes a capacitive ring 110 radially outside of the conical radiation element 102 and in proximity to the conical radiation element 102. The capacitive ring 110 is configured to be connected to a ground plane 111 for the monocone antenna 100. The capacitive ring 110 is designed for impedance matching. The capacitive ring 110 adds capacitance to the monocone antenna 100 and lowers inductance of the conical radiation element 102. The conical radiation element 102 is electrically shortened, such as to a height less than one-quarter wavelength, to increase its conformity. Optionally, the conical radiation element 102 may be less than one-tenth of a free space wavelength in height. The capacitive ring 110 mitigates the added inductance due to the electrically short conical radiation element 102. The monocone antenna 100 is a very short, vertically polarized antenna which may be installed on an aircraft surface or recessed into the aircraft surface to reduce aerodynamic drag and potential for damage by limiting protrusion or height above the aircraft surface.

A capacitive gap 112 is defined between the conical radiation element 102 and the capacitive ring 110. The capacitive gap 112 is substantially filled with dielectric material. The dielectric material may be a plastic material. The dielectric material may be air. The size of the capacitive gap 112 controls the spacing between the conical radiation element 102 and the capacitive ring 110. The size of the capacitive gap 112 is designed for impedance matching. The spacing between the conical radiation element 102 and the capacitive ring 110 controls the added capacitance therebetween for impedance matching.

Figure 7:
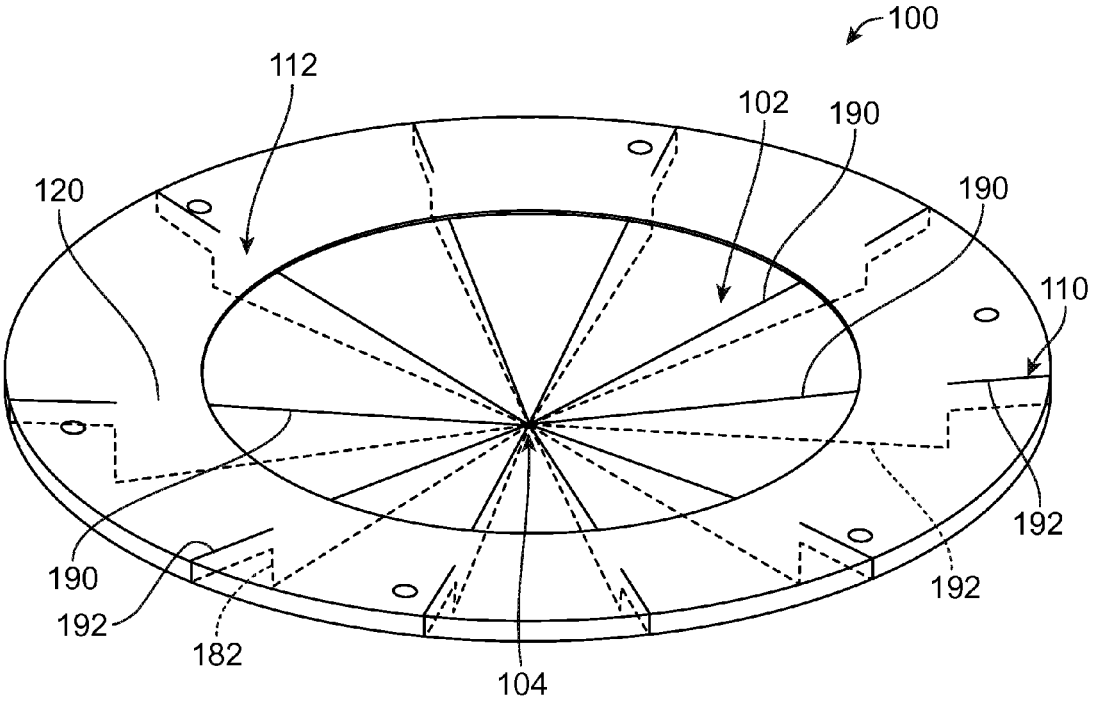
FIG. 7 is a top perspective view of the monocone antenna in accordance with an exemplary embodiment.

The monocone antenna 100 may be constructed of one or more conductors defining the conical radiation element 102. The conductor or conductors forming the conical radiation element 102 may be solid or may be partially solid, such as an array of conductors disposed conically about the common feed point 104. The conductor or conductors forming the conical radiation element 102 may be a surface or may be a wire grid, such as one or more wires connected near the vertex of the conical radiation element 102 and disposed conically about the common feed point 104. The wires or conductors in the array need not be of the same length in defining the conical radiation element 102. In the illustrated embodiment, the conical radiation element 102 is a solid, continuous surface forming the conical radiation element 102, however FIG. 7 illustrates an alternative conical radiation element 102 formed from discrete wires or conductors forming a discontinuous array disposed conically about the feed point 104.

In an exemplary embodiment, the monocone antenna 100 includes a substrate 120. The conical radiation element 102 is provided on one or more surfaces of the substrate 120 while the capacitive ring 110 is provided on one or more other surfaces of the substrate 120. The substrate 120 may substantially fill the capacitive gap 112. The substrate 120 is manufactured from a dielectric material, such as a plastic material, a ceramic material, or another dielectric material. In one particular example, the substrate 120 is a synthetic material such as acrylonitrile butadiene styrene (ABS). Optionally, the substrate 120 may be a layered structure.

The substrate 120 has a top 122 and a bottom 124. The substrate 120 has a conical cavity 126 defined by an inner cavity wall 128. In an exemplary embodiment, the conical radiation element 102 covers at least part of the inner cavity wall 128. The conical cavity 126 is open at the top 122. The conical cavity 126 extends vertically into the substrate 120 between the top 122 and the bottom 124. The feed point 104 may be provided at or near the bottom 124.

In an exemplary embodiment, the substrate 120 includes a mounting flange 130 for mounting the monocone antenna 100 to a mounting surface, such as a surface of the aircraft or airframe. The mounting flange 130 includes mounting openings 132 that are configured to receive fasteners (not shown) used to secure the monocone antenna 100 to the mounting surface. Optionally, the mounting flange 130 may be provided at or near the top 122. Alternatively, the mounting flange 130 may be provided remote from the top 122, such as at or near the bottom 124. In an exemplary embodiment, the capacitive ring 110 covers at least a portion of the mounting flange 130.

The substrate 120 includes a base 134, which may be provided at or near the bottom 124. The mounting flange 130 may extend radially outward from the base 134. The base 134 may be provided below the mounting flange 130. The base 134 is configured to be embedded in the mounting structure, such as within the aircraft or airframe. The base 134 has a smaller diameter than the mounting flange 130.

The conical radiation element 102 extends between a top 140 and a bottom 142. The feed point 104 is provided at the bottom 142. The conical radiation element 102 is tapered between the top 140 and the bottom 142. The conical radiation element 102 converges at the vertex at the bottom 142. The diameter of the conical radiation element 102 is larger at the top 140 than at the bottom 142. The conical radiation element 102 extends a vertical height between the top 140 and the bottom 142. The vertical height may be less than or equal to a height of the substrate 120.

In an exemplary embodiment, the conical radiation element 102 is provided directly on the inner cavity wall 128 of the conical cavity 126 of the substrate 120. For example, the conical radiation element 102 may be deposited on the inner cavity wall 128. The conical radiation element 102 may be plated on the inner cavity wall 128. The conical radiation element 102 may be deposited by other processes in alternative embodiments, such as vapor deposition, chemical deposition, or other coating or layering processes. The conical radiation element 102 may be a metal layer on the inner cavity wall 128. For example, the conical radiation element 102 may be a metal layer of copper, aluminum, brass, tin, or another conductive metal material.

The capacitive ring 110 surrounds the conical radiation element 102. In an exemplary embodiment, the capacitive ring 110 is provided on an exterior of the substrate 120. For example, the capacitive ring 110 may be provided on the top 122, on the bottom 124 and/or on the side wall 136 of the substrate 120. The capacitive ring 110 may be deposited directly on the exterior of the substrate 120. The capacitive ring 110 may be plated on one or more surfaces of the substrate 120. The capacitive ring 110 may be deposited by other processes in alternative embodiments, such as vapor deposition, chemical deposition, or other coating or layering processes. The capacitive ring 110 may be a metal layer on the substrate 120. For example, the conical radiation element 102 may be a metal layer of copper, aluminum, brass, tin, or another conductive metal material. Optionally, the capacitive ring 110 may be embedded in the substrate 120 in addition to, or in lieu of, being deposited on the exterior of the substrate 120.

The capacitive ring 110 extends between a top 150 and a bottom 152. The top 150 may extend along the top 122 of the substrate 120. The bottom 152 may extend along the bottom 124 of the substrate 120. Optionally, the top 150 may be generally co-planar with the top 140 of the conical radiation element 102. The bottom 152 may be generally co-planar with the bottom 142 of the conical radiation element 102. In the illustrated embodiment, the capacitive ring 110 is deposited directly on the bottom 124, the side wall 136 and the top 122 of the substrate 120.

The substrate 120 has an exposed surface 154 (FIG. 1) at the top 122 between the top 150 of the capacitive ring and the top 140 of the conical radiation element 102. The exposed surface 154 may have any shape. In the illustrated embodiment, the exposed surface 154 is ring shaped. A width 156 of the exposed surface 154 defines a spacing between the top 150 of a capacitive ring 110 and the top 140 of the conical radiation element 102. The spacing controls the capacitance between the conical radiation element 102 and the capacitive ring 110 for matching the impedance of the monocone antenna 100. In an exemplary embodiment, the substrate 120 has an exposed surface 158 (FIG. 3) at the bottom 124 of the substrate 120. The exposed surface 158 isolates the conical radiation element 102 from the capacitive ring 110 to control a capacitance therebetween.

In an exemplary embodiment, the mounting flange 130 includes an upper surface 160, a lower surface 162 and a side surface 164 between the upper and lower surfaces 160, 162 around the perimeter edge of the mounting flange 130. The upper surface 160 may define a portion of the top 122 of the substrate 120. The lower surface 162 and/or side surface 164 may define a portion of the side wall 136 of the substrate 120. In an exemplary embodiment, the capacitive ring 110 is provided on the upper surface 160, the lower surface 162 and the side surface 164, however the capacitive ring 110 may be provided on less than all of the surfaces of the mounting flange 130 in alternative embodiments.

In an exemplary embodiment, the base 134 includes a side surface 170 and a lower surface 172. The side surface 170 may extend vertically below the mounting flange 130 to the lower surface 172. The side surface 170 may define at least a portion of the side wall 136 of the substrate 120. The lower surface 172 may define at least a portion of the bottom 124 of the substrate 120. In an exemplary embodiment, the capacitive ring 110 may be provided on the side surface 170 and the lower surface 172, however the capacitive ring 110 may be provided on less than all of the surfaces of the base 134 in alternative embodiments.

Optionally, the side surface 170 may be generally perpendicular to the lower surface 172. For example the lower surface 172 may extend horizontally and the side surface 170 may extend vertically. Alternatively, the side surface 170 may extend transverse to the lower surface 172. For example, the side surface 170 may be angled relative to the lower surface 172. Optionally, the side surface 170 may be angled parallel to the inner cavity wall 128.

In an exemplary embodiment, the capacitive ring 110 is a continuous conductive surface or layer on the lower surface 172 of the base 134, the side surface 170 of the base 134, the lower surface 162 of the mounting flange 130, the side surface 164 of the mounting flange 130 and the upper surface 160 of the mounting flange 130, while the conical radiation element 102 is a continuous conductive surface or layer on the inner cavity wall 128. The substrate 120 substantially fills the capacitive gap 112 between the conical radiation element 102 and the capacitive ring 110. The shape of the capacitive gap 112 and the material filling the capacitive gap 112 affect the capacitance for impedance matching between the conical radiation element 102 and the capacitive ring 110. In an exemplar embodiment, a width of the substrate 120 between the conical radiation element 102 and the capacitive ring 110 is variable along the height of the substrate 120 between the top 122 and the bottom 124 of the substrate 120. For example, the spacing between the conical radiation element 102 and the capacitive ring 110 along the mounting flange 130 may be different than the spacing between conical radiation element 102 and the capacitive ring 110 along the base 134. Additionally, the spacing between the conical radiation element 102 along the inner cavity wall 128 and the side surface 164 of the mounting flange 130 may vary at different vertical positions (e.g., the spacing increases at lower vertical positions because the inner cavity wall 128 is angled inward). Additionally, the spacing between the conical radiation element 102 along the inner cavity wall 128 and the side surface 170 of the base 134 may vary at different vertical positions (e.g., the spacing increases at lower vertical positions because the inner cavity wall 128 is angled inward).

Figure 4:
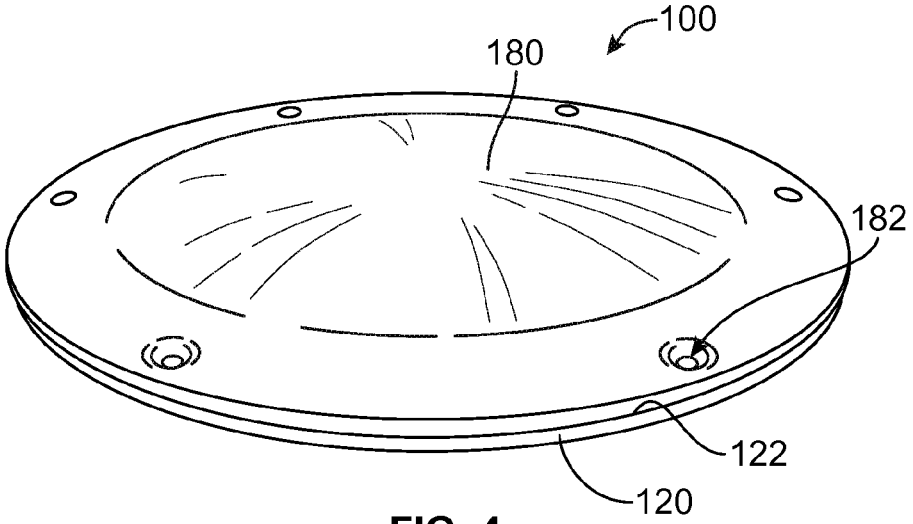
FIG. 4 is a top perspective view of the monocone antenna with a radome.
Figure 5:
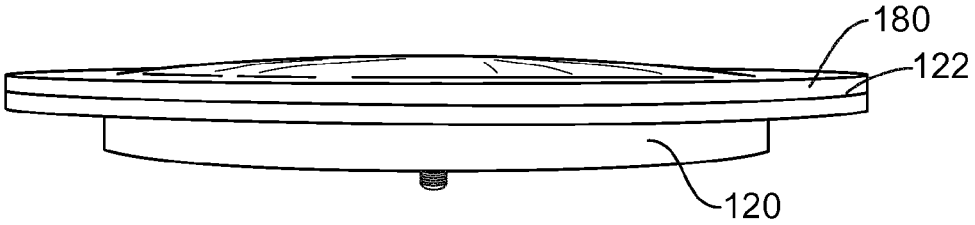
FIG. 5 is a side view of the monocone antenna and radome.

FIG. 4 is a top perspective view of the monocone antenna 100 with a cover or radome 180 attached to the top 122 of the substrate 120. FIG. 5 is a side view of the monocone antenna 100 and radome 180. The radome 180 may define an exterior of the monocone antenna 100 and may be generally flush with an exterior surface of the aircraft or airframe. The radome 180 includes mounting openings 182, which may be aligned with the mounting openings 182 of the monocone antenna 100. Fasteners may pass through the radome 180 and the monocone antenna 100 to secure the monocone antenna 100 to the aircraft or airframe. The radome 180 may have a slight convex curvature.

Figure 6:
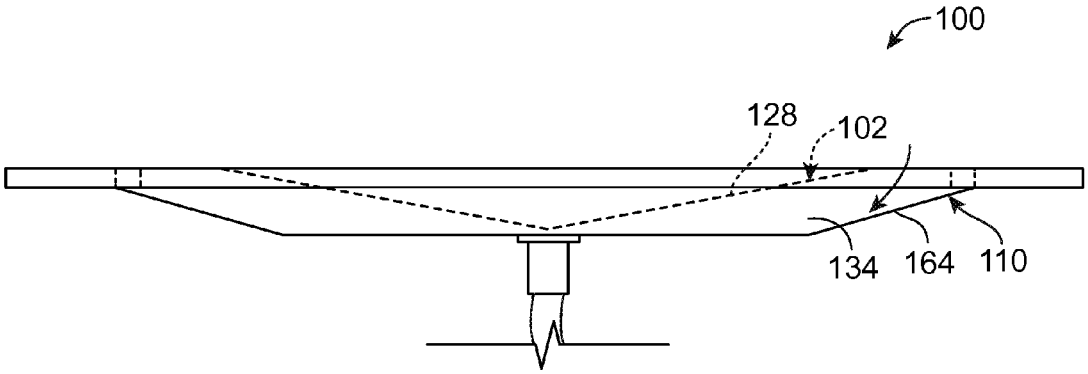
FIG. 6 is a side view of the monocone antenna in accordance with an exemplary embodiment.

FIG. 6 is a side view of the monocone antenna 100 showing the base 134 with a different shape. The base 134 includes an angled side surface 164, which may be generally parallel to the inner cavity wall 128. As such, the capacitive ring 110 on the angled side surface 164 may extend generally parallel to the conical radiation element 102. The spacing between the capacitive ring 110 and the conical radiation element 102 is different in the embodiment shown in FIG. 6 than the embodiment shown in FIG. 2. The capacitance may be greater in the embodiment shown in FIG. 6 than the embodiment shown in FIG. 2.

FIG. 7 is a top perspective view of the monocone antenna 100 with the conical radiation element 102 formed from discrete wires or conductors 190 forming a discontinuous array disposed conically about the feed point 104. The capacitive ring 110 is also formed from discrete wires or conductors 192 forming a discontinuous array disposed radially outside of the conical radiation element 102. The substrate 120 supports the wires or conductors 190 and 192. The wires or conductors 190, 192 may be affixed to the substrate. Air may partially or substantially fill the capacitive gap 112 between the capacitive ring 110 and the conical radiation element 102.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof)

may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A monocone antenna comprising:

a conical radiation element having a feed point at a vertex of the conical radiation element being connected to a feed transmission line;

a capacitive ring radially outside of the conical radiation element and in proximity to the conical radiation element, the capacitive ring being conductive and providing capacitance to the monocone antenna, the capacitive ring being connected to a ground plane of the monocone antenna; and a substrate having a base, a top and a side wall between the base and the top, the substrate having a conical cavity with the conical radiation element positioned in the conical cavity, the capacitive ring being positioned on the base, the top and the side wall, wherein the substrate has a mounting flange at the top, the mounting flange having an upper surface, a lower surface and a side surface between the upper surface and the lower surface, the capacitive ring extending along the upper surface, the side surface and the lower surface.

2. The monocone antenna of claim 1, further comprising a capacitive gap between the conical radiation element and the capacitive ring, the capacitive gap being substantially filled with dielectric material.

3. The monocone antenna of claim 1, wherein the conical radiation element is deposited directly on an inner cavity wall of the substrate defining the conical cavity.

4. The monocone antenna of claim 1, wherein the capacitive ring is deposited directly on the base, the top and the side wall.

5. The monocone antenna of claim 1, wherein the substrate has an exposed surface at the top between the capacitive ring and the conical radiation element.

6. The monocone antenna of claim 1, wherein the base extends below the mounting flange, the base having a side surface and a lower surface, the lower surface defining a bottom of the substrate, the side surface defining at least a portion of the side wall, the capacitive ring extending along the lower surface of the base and the side surface of the base to the lower surface of the mounting flange.

7. The monocone antenna of claim 6, wherein the side surface of the base extends vertically between the lower surface of the base and the mounting flange.

8. The monocone antenna of claim 6, wherein the side surface of the base is angled between the lower surface of the base and the mounting flange, the side surface of the base extending generally parallel to an inner cavity wall defining the conical cavity.

9. The monocone antenna of claim 1, wherein the mounting flange has mounting openings configured to receive fasteners.

10. The monocone antenna of claim 1, wherein the conical radiation element is continuous.

11. The monocone antenna of claim 1, wherein the conical radiation element is discontinuous.

* * * * *